United States Patent [19]

Woods

[11] 4,199,740

[45] Apr. 22, 1980

[54] SWITCH DEVICE AND METHOD OF MAKING

[75] Inventor: Lee O. Woods, Morrison, Ill.

[73] Assignee: General Electric Company, Fort Wayne, Ind.

[21] Appl. No.: 899,595

[22] Filed: Apr. 24, 1978

[51] Int. Cl.[2] ..... H01H 9/02; H01H 13/04

[52] U.S. Cl. ..... 335/202; 29/622; 200/302; 200/304; 335/128

[58] Field of Search ..... 335/128, 201, 202; 200/147 B, 302, 304, 305; 29/622

[56] References Cited

U.S. PATENT DOCUMENTS

| | | | |
|---|---|---|---|
| 3,130,284 | 4/1964 | Woods | 200/111 |
| 3,179,771 | 4/1965 | McGary | 335/201 X |
| 3,243,546 | 3/1966 | Woods | 200/87 |
| 3,806,849 | 4/1974 | Hughes | 335/201 |

*Primary Examiner*—Fred L. Braun

*Attorney, Agent, or Firm*—Joseph E. Papin

[57] ABSTRACT

A switch device has a housing with a chamber therein including at least one surface, and terminal members and switch elements are arranged in the chamber for electrical engagement and disengagement, respectively. A pedestal is integrally formed with the at least one surface and has a free end predeterminately spaced from the at least one surface. The terminal members are engaged with the free end and predeterminately extended beyond the marginal edges thereof so as to shield at least a part of the pedestal from the depositing thereon of any minute conductive material particles emanating in an arc blast from at least one of the terminal members and the switching elements upon the electrical disengagement thereof under load thereby to prevent the establishment cf a conductive path of the deposited particles across the pedestal between the terminal members and the at least one surface. A method of making a switch device is also disclosed.

6 Claims, 4 Drawing Figures

SWITCH DEVICE AND METHOD OF MAKING

FIELD OF THE INVENTION

This invention relates in general to electrical switching apparatus and in particular to a switch or relay device having components arranged to prevent arc blast tracking and also to a method of making a switch or relay device.

BACKGROUND OF THE INVENTION

In the past, electrical switching apparatus, such as a switch or relay device for instance, was provided with a dielectric housing having a switch means accommodating chamber therein, and a plurality of surfaces were provided on the housing defining the chamber. A pair of electrical conductive members, such as a terminal and a movable switch arm for instance, were associated with the housing so as to be disposed at least in part in the chamber, and each carried a contact for electrical making engagement and breaking disengagement with respect to each other. Of course, breaking a generally high A.C. current with a set of contacts drew or resulted in an arc blast or blow-out between these contacts, and the arc blast persisted generally until the A.C. wave of such current went through zero. When the current was broken by the disengagement of these contacts, the arc blast ballooned or bloomed outside or generally away from the surface area of the contacts, and upon the formation of such an arc blast, discrete or minute conductive particles of contact material were disassociated from the contacts so as to emanate therefrom. The emanating minute conductive particles of the contact material effected upon the establishment of the aforementioned arc blast was generally thought of as being comparable to a metallic vapor. At least one of the disadvantageous or undesirable features of the past switching apparatus is believed to be that the emanating minute conductive particles of contact material, i.e. the metallic vapor, created in response to the arc blast was deposited on at least some of the surfaces of the switch means accommodating chamber; therefore, upon an accumulation of such metallic vapor on the chamber surfaces, it is believed that the dielectric strength thereof eventually failed being unable to withstand the hi-pot voltages of the switch device.

SUMMARY OF THE INVENTION

Among the several objects of the present invention may be noted the provision of an improved switch device and an improved method of making a switch device which overcome the above discussed disadvantageous or undesirable features, as well as others, of the prior art; the provision of such switch device and method in which terminal means is predeterminately arranged with a seating extension therefor integral with the switch device housing so as to at least in part shield such seating extension from the metallic vapor effected in response to any arc blast created in the switch device; the provision of such switch device and method in which the terminal means is engaged with a free end portion of the extension and extends thereover and beyond marginal edge portions thereof so as to prevent the depositing of the metallic vapor created in response to the arc blast upon at least a shielded part of wall means on the extension between the free end portion and a housing surface with which the extension is integrally formed; the provision of such switch device and method in which the formation of a conductive path of the deposited metallic vapor is obviated across the at least shielded part of the wall means of the extension; and the provision of such switch device and method in which the components thereof are simplistic in design, economically manufactured, and easily assembled. These as well as other objects and advantageous features of the present invention will be in part apparent and in part pointed out hereinafter.

In general, a switch device in one form of the invention has a housing with a chamber therein, and at least one surface is provided on the housing within the chamber. Terminal means is associated with the housing and disposed at least in part within the chamber, and switch means movable in the chamber is adapted for electrical engagement with and disengagement from the terminal means. Means is integral with the at least one surface and extends therefrom for positioning engagement with the terminal means, and a plurality of wall means is provided on the positioning engagement means. One of the wall means of the plurality thereof is predeterminately spaced from the at least one surface and arranged in abutment with the terminal means, and at least another of the wall means of the plurality thereof is arranged so as to extend completely around the positioning engagement means in interconnecting relation only between the one wall means and the at least one surface. The terminal means has a portion extending at least a predetermined distance beyond the interconnection of the one wall means and the at least another wall means and completely around it so as to shield at least a part of the at least another wall means extending completely around the positioning engagement means adjacent the one wall means from any conductive material emanating from at least one of the terminal means and the switch means in response to any arc blast established therebetween upon the disengagement of the switch means from the terminal means so as to prevent the depositing of the emanating conductive material on the shielded at least part of the at least another wall means and obviate the establishment of a conductive path there across of the emanating conductive material between the terminal means and the at least one surface.

Also in general and in one form of the invention, a method is provided for making a switch device having a chamber with a plurality or surfaces therein. Terminal means is disposed at least in part within the chamber, and switch means is movable for circuit breaking disengagement from the terminal means so that any arc blast created upon the disengagement effects the emanation from at least one of the switch means and the terminal means of minute particles of conductive material and the depositing of the minute particles on at least one of the surfaces of the surface plurality. In this method, an integral pedestal is provided on the at least one surface with the pedestal having a free end portion predeterminately spaced from the at least one surface and wall means interconnected between the free end portion and the at least one surface so as to extend completely around the pedestal in circumscribing relation therewith. The terminal means is mounted with respect to the pedestal so that a peripheral portion of the terminal means extends at least a predetermined distance beyond the free end portion, and at least a band extending completely about the wall means in circumscribing relation therewith and disposed between the free end portion and the at least one surface is thereby shielded from the depositing on the band of the minute particles of the conductive material so as to obviate the establishment of a conductive path of the minute particles of the conductive material on the band between the at least one surface and the terminal means.

BRIEF DESCRIPTION OF THE DRAWINGS

Corresponding reference characters refer to corresponding parts throughout the several views of the drawings.

The exemplifications set out herein illustrate the preferred embodiment of the invention in one form thereof, and such exemplifications are not to be construed as limiting the scope of the disclosure or the scope of the invention in any manner.

DETAILED DESCRIPTION OF THE PREFERRED EMBODIMENT

Figure 1:
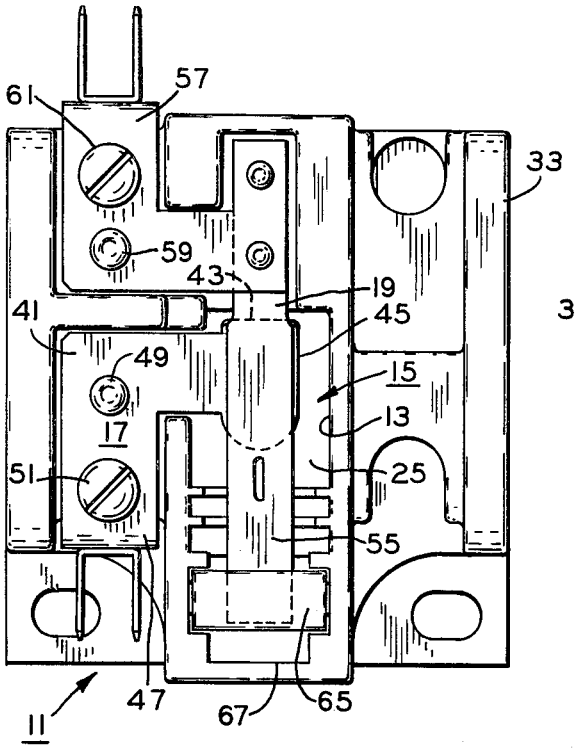
FIG. 1 is a plan view of a switch device in one form of the invention.
Figure 2:
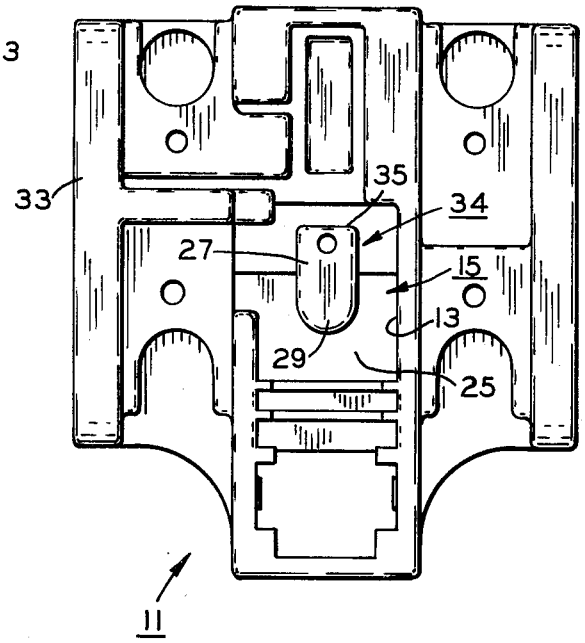
FIG. 2 illustrates the switch device of FIG. 1 with a switch arm and terminal means thereof removed to show the switch means accommodating chamber details.
Figure 3:
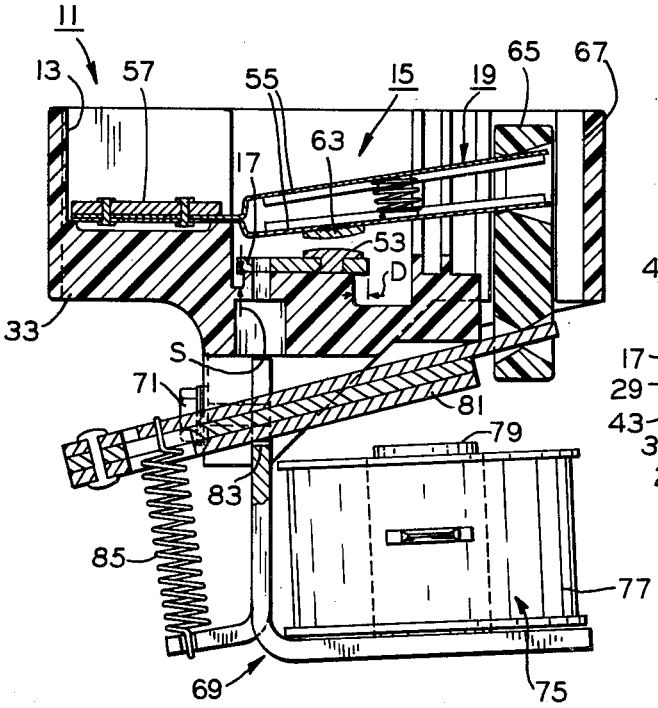
FIG. 3 is a partial sectional view taken along line 3—3 of FIG. 1 and illustrating principles which may be practiced in a method of making a switch device in one form of the invention.
Figure 4:
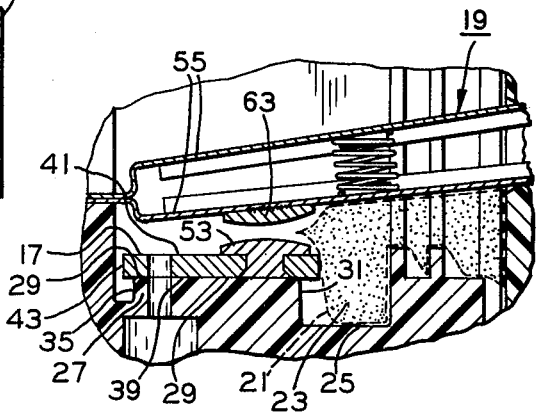
FIG. 4 is a greatly enlarged partial sectional view taken along line 3—3 of FIG. 2 and schematically showing an arc blast as may occur in the switch device.

Referring now to the drawings in general, there is illustrated in one form of the invention a method of making a switch or relay device 11 having a switch means accommodating chamber 13 with a plurality of surfaces 15 therein (FIGS. 1 and 2). A terminal means 17 is disposed at least in part in chamber 13, and a switch means 19 is movable in the chamber for making engagement with and breaking disengagement from the terminal means (FIGS. 1 and 3). The breaking disengagement under load of switch means 19 from terminal means 17 creates or establishes an arc blast or blow-out, indicated pictorially at 21, which effects the disassociation and emanation from at least one of the terminal means and the switch means of minute particles of metallic or conductive material 23 thereof, i.e. in the form of a metallic vapor for instance, and the depositing of the particles on at least one surface 25 of surface plurality 15 (FIG. 4). In this method, an integral pedestal or extension 27 is provided on surface 25 with the pedestal having a free end or end portion 29 predeterminately spaced a distance S from the surface. Terminal means 17 is mounted on or over free end portion 29 of pedestal 27 so as to extend at least a predetermined distance D across or over and beyond the free end portion, and at least a part 31 of the pedestal is thereby shielded from the depositing on pedestal shielded part 31 of particles 23 so as to obviate the establishment of a conductive path of the particles between terminal means 17 and surface 25.

More particularly and with specific reference to FIGS. 1 and 2, switch device 11 is provided with a housing 33 of suitable dielectric material, and chamber 13 is disposed in the housing with chamber surface plurality 15 defined on the housing. However, while chamber 13 is illustrated herein as being open-ended, i.e. accessible from exteriorly of housing 33, it is contemplated that the chamber may be enclosed within the housing within the scope of the invention so as to meet the objects thereof. Pedestal or extension means 27 is integrally formed on chamber surface 25 so as to extend therefrom into chamber 13 the predetermined distance S, as previously mentioned. A plurality of wall means 34 are provided on pedestal 27 including free end portion 29 and a peripheral or circumferential wall means 35 which not only extends completely around the pedestal in circumscribing relation therewith but also is integrally interconnected or intersected between chamber surface 25 and the free end portion of the pedestal. Thus, the intersection or interconnection of wall means 35 with free end portion 29 defines a peripheral or circumferential marginal edge or edge portion 37 which extends generally about or completely around the free end portion in circumscribing relation therewith. While free end portion 29 is illustrated herein as being generally planar, it is contemplated that the free end portion may have other shapes or configurations within the scope of the invention so as to meet the objects thereof.

Terminal means 17 may be of any suitable electrical conductive material and is provided with a pair of opposite faces or sides 39, 41 interposed between a marginal edge 43. A supporting or seating section 45 is provided on terminal means 17 within chamber 13, and an electrical connector section 47 integrally extends from the seating section so as to be disposed exteriorly of the chamber. The shape or configuration of seating section 45 on terminal means 17, as generally defined by marginal edge 43 thereof, is generally dictated by the shape or configuration of pedestal 27, as will become apparent from the following discussion, and while particular shapes of both the pedestal and the seating section are illustrated herein for purposes of disclosure, it is contemplated that the pedestal and the seating section may be provided with various other shapes or configurations within the scope of the invention so as to meet the objects thereof. When terminal means 17 is mounted or otherwise arranged with pedestal 27, as previously mentioned, seating section 45 of the terminal means is disposed over or seated on free end portion 29 of the pedestal with opposite face 39 of the terminal means disposed in abutting engagement therewith and in opposed facing relation with chamber surface 25. When so mounted, it may be noted that marginal edge 43 on seating section 45 of terminal means 17 is disposed so as to extend at least the predetermined distance D beyond marginal edge portion 37 on free end portion 29 of pedestal 27. This extension or overlay, i.e. the predetermined distance D, of seating section 45 with respect to free end portion 29 of pedestal 27 is effective to shield the afore-mentioned shielded part or band about wall means 35 of the pedestal at least immediately beneath terminal means 17 from the arc blast effected upon the disengagement of switch means 19 from terminal means 17 under load. Thus, the shielding or umbrella affect of seating section 45 with respect to pedestal 27 prevents the depositing of particles 23 accompanying the aforementioned arc blast onto shielded band 31 which extends completely around the pedestal in circumscribing relation therewith so as to obviate the establishment of a conductive path of the particles between terminal means 17 and chamber surface 25. Of course, when seating section 45 of terminal means 17 is so disposed in its overlaying or overhanging relation with pedestal 27, as discussed above, it may also be noted that marginal edge 43 of the terminal means is predeterminately spaced from adjacent or confronting chamber surfaces of surface plurality 15 in order to prevent the establishment of a conductive path therebetween in the event of the depositing on such surfaces of particles 23 in response to the arc blast created between the terminal and switch means 19 when they are disengaged from each other under load.

Referring again in general to the drawings and recapitulating at least in part with respect to the foregoing, switch or relay device 11 has housing 33 with chamber 13 therein, and chamber surface 25 is provided on the housing (FIG. 1). Terminal means 17 is associated with housing 33 and disposed at least in part within chamber 13 adjacent surface 25 thereof, and switch means 19 is movable in the chamber for electrical engagement with the terminal means and disengagement therefrom (FIGS. 1 and 2). Means, such as pedestal 27, is integral with surface 25 and extends therefrom for positioning engagement with terminal means 17, and wall means plurality 34 is provided on the pedestal or positioning engagement means (FIG. 3). One wall means, such as free end portion 29, of wall means plurality 34 is predeterminately spaced, i.e. the distance S, from surface 25 and arranged in abutment with terminal means 17, and another wall means 35 of the wall means plurality extends about free end portion 29 and is interconnected between the free end portion and chamber surface 25 (FIGS. 3 and 4). Terminal means 17 extends at least the predetermined distance D beyond the intersection of free end portion 29 and wall means 35 so as to shield band 31 about wall means 35 from any conductive material, i.e. particles 23, emanating from at least one of terminal means 17 and switch means 19 in response to any electrical arc blast therebetween when the switch means is disengaged from the terminal means thereby to prevent the depositing of the emanating particles on band 31 and obviate the establishment of a conductive path of the particles thereacross between the terminal means and surface 25 (FIGS. 3 and 4).

More particularly and with specific reference to FIGS. 1 and 2, electrical connection section 47 of terminal means 17 is secured by suitable means, such as a rivet 49 for instance, to housing 33, and is provided with suitable means, such as a screw connector 51 for instance, for the attachment of an external lead (not shown). Terminal means 17 also includes a contact 53 of suitable metallic material which is attached by suitable means (not shown) to seating section 45 of the terminal means on opposite face 41 thereof. Switch means 19 includes a switch arm 55 formed of a suitable resilient current carrying material, and a pivoted end of the switch arm is overlaid by another terminal 57 with the terminal and the switch arm being secured by suitable means, such as rivets 59 for instance, to housing 33. Terminal 57 also includes means, such as a screw connector 61 for instance, for attachment to an external lead (not shown). Another or movable contact 63 of suitable metallic material is secured to switch arm 55 generally adjacent the mid-portion thereof and adapted for making engagement with and breaking disengagement from contact 53 on terminal means 17. The free end of switch arm 55 is arranged in driven engagement with a plunger 65 reciprocally movable in an aperture 67 provided through housing 33 and intersecting with chamber 13. Thus, the reciprocal movement of plunger 65 in aperture 67 pivotally moves switch arm 55 to effect the engagement and disengagement of switch arm contact 63 and terminal means contact 53.

A generally L-shaped frame or yoke 69 formed of a suitable magnetic material is connected by suitable means, such as a screw 71 for instance, to the underside of housing 33. Mounted on a foot portion 73 of yoke 69 is an electromagnet 75 including a generally cylindrical coil means 77 having a current carrying capacity for energizing a pole piece 79 disposed generally coaxially within the coil means. An armature 81 is pivotally arranged in a slot 83 provided in yoke 69 for pivotal movement into magnetic holding engagement with pole piece 79 upon its magnetization in response to excitation of coil means 77. One end of armature 81 is drivingly engaged with plunger 65 so as to effect the reciprocal downward movement thereof in housing aperture 67 in response to the pivotal movement of the armature into magnetic holding engagement with pole piece 79, and another or opposite end of the armature is resiliently urged or pivoted by suitable means, such as a spring 85 for instance, in a direction opposite to the magnetic attraction movement of the armature toward the holding engagement thereof with the pole piece.

In the operation of switch device 11 with the component parts thereof disposed as shown in the drawings, excitation or energization of coil means 77 effects the magnetization of pole piece 79. When so magnetized, pole piece 79 magnetically attracts armature 81 into magnetic holding engagement therewith, and upon such magnetic attraction, the armature is pivotally moved in the clockwise direction (as best seen in FIG. 3) about slot 83 in yoke 69 against the compressive force of spring 85. Of course, this pivotal movement of armature 81 into the magnetic holding engagement with pole piece 79 conjointly drives plunger 65 downwardly in housing aperture 67, and such downward movement of the plunger also generally conjointly effects the pivotal movement therewith of switch arm 55 so as to make contact 63 thereon with contact 53 on terminal means 17. This making of contacts 53,63 completes an electrical circuit through switch device 11 to permit current flow from screw connector 51 of terminal means 17 through the terminal means, the made contacts 53, 63, switch arm 55 and terminal 57 to screw connector 61 thereof.

When coil means 77 is deenergized, the magnetizing effect thereof on pole piece 79 is, of course, terminated along with the magnetic attraction between the pole piece and armature 81, and the compressive force of spring 85 acts to pivotally return the armature to its at-rest position disengaged from the pole piece (as best seen in FIG. 3). The return pivotal movement of armature 81 about slot 83 in yoke 69 in response to the compressive force of spring 85 effects the conjoint driven movement with the armature of plunger 65 in an upwardly direction in housing aperture 67. This upward movement of plunger 65 conjointly pivots or returns switch arm 55 therewith to the at-rest position of the switch arm so as to break or disengage movable contact 63 on the switch arm from contact 53 on terminal means 17. In this manner, the breaking of contacts 53, 63 interrupts the aforementioned circuit through switch device 11, and when contacts 53, 63 are so disengaged or broken under load, the aforementioned arc blast, as pictorially illustrated at 21 in FIG. 4, occurs. Upon the occurrence of the arc blast, particles 23 are electrically disassociated from at least one of contacts 53, 63 and emanate therefrom generally in the form of a metallic vapor, as previously mentioned. The arc blast extends from between contacts 53, 63 and balloons outwardly away from the surfaces of the contacts generally only in one direction, and of course, as the ballooning arc blast strikes the chamber surfaces 15, the particles are deposited thereon so as to form a conductive layer or skin on such chamber surfaces. However, due to the overlay of terminal means seating section 45, i.e. the predetermined distance D, with respect to marginal edge portion 37 of pedestal free end portion 29, such overlay acts to direct the ballooning arc blast generally away from shielded band 31 about wall means 35 of pedestal 27, and in this manner, any particles 23 carried with the ballooning arc blast are prevented from being deposited in the area of shielded band 31. It may be noted that even though particles 23 may be deposited upon the occurrence of the arc blast on chamber surfaces 15, the prevention of such particle depositing on shielded band 31 extending completely around or about wall means 35 of pedestal 27 obviates the possibility of creating a conductive path of such particles between terminal means 17 and chamber surface 25. Thus, there is also obviated the possibility of creating a short-circuiting path of deposited particles on chamber surfaces 15 between terminal means 17 and switch means 19. It may also be noted that the shielding effect of the terminal means seating section 45 with respect to pedestal 27, as discussed above, also protects the shielded band 31 about wall means 35 of pedestal 27 from the heat of the arc blast which may decompose some resin materials causing the electrical characteristics thereof to change from insulative to conductive.

In view of the foregoing, it is now submitted that a novel switch device 11 and a novel method of making a switch device have been provided meeting the objects set out hereinbefore, as well as others, and that changes may be made by those having ordinary skill in the art not only as to the precise arrangement, shapes, details and connections of the constructions set forth herein but also with respect to the precise arrangements and order of steps of the method without departing from the spirit of the invention or the scope of the invention which is illustrated by the claims which follow.

What I claim as new and desire to secure by Letters Patent of the United States is:

1. In a switch device having a dielectric material housing, a chamber in the housing, at least one surface on the housing and within the chamber, coil means associated with the housing and adapted for electrical energization, switch means movable in the chamber, means arranged in magnetic coupling relation with the coil means for effecting the actuation of the switch means between an at-rest position and an actuated position upon the electrical energization and deenergization of the coil means, respectively, a contact on the switch means, a terminal associated with the housing and having a section within the chamber, a pair of opposite faces on the terminal section with one of the opposite faces being arranged generally in opposed spaced relation with the at least one surface, another contact on the other of the opposite faces of the terminal section and arranged to engage with the first named contact upon the actuation of the switch means to its actuated position and to disengage the first named contact upon the return of the switch means to its at-rest position, and means for preventing the establishment of a conductive path between the at least one surface and the terminal section of minute contact material particles emanating from at least one of the first named contact and the another contact and deposited on the at lease one surface in response to an arc blast created between the first named contact and the another contact at least upon the disengagement thereof; the improvement wherein the preventing means comprises an extension on the housing and integrally formed with the at least one surface within the chamber, a free end on said extension predeterminately spaced from the at least one surface and arranged to engage with the one opposite face of the terminal section, wall means on said extension disposed so as to extend generally in circumscribing relation about said extension and interconnecting between the at least one surface and said free end of said extension so as to generally define a marginal edge portion extending generally in circumscribing relation about said free end, the terminal section extending over said free end of said extension beyond said marginal egde portion at least a preselected distance so as to shield at least a band on said wall means extending generally in circumscribing relation completely thereabout from not only heat of the arc blast but also from the particles emanating from the at least one of the first named contact and the another contact in response to the arc blast therebetween and thereby to prevent the establishment of the conductive path across said band extending in the circumscribing relation thereof completely about said wall means and disposed between the at least one surface and the one face of the terminal section.

2. In a switch device having a housing with a chamber therein, at least one surface on the housing within the chamber, terminal means associated with the housing and disposed at least in part within the chamber, switch means movable in the chamber and adapted for electrical contacting engagement with the terminal means and disengagement therefrom, and means integral with the at least one surface and extending therefrom for positioning engagement with the terminal means, and a plurality of wall means on the positioning engagement means; the improvement comprising that one of the wall means of the plurality thereof is predeterminately spaced from the at least one surface and arranged in abutment with the terminal means and at least another of the wall means of the plurality thereof is arranged so as to extend completely around the positioning engagement means in interconnecting relation only between the one wall means and the at least one surface, and the terminal means having a portion extending at least a predetermined distance beyond the interconnection of the one wall means and the at least another wall means and completely around it so as to shield at least a part of the at least another wall means extending completely around the positioning engagement means adjacent the one wall means from any conductive material emanating from at least one of the terminal means and the switch means in response to any electrical arc blast established therebetween when the switch means is disengaged from the terminal means thereby to prevent the depositing of the emanating conductive material on said shielded at least part of the at least another wall means and obviate the establishment of a conductive path thereacross of the emanating conductive material between the terminal means and the at least one surface.

3. The switch device as set forth in claim 2 including a pair of contacts on the terminal means and the switch means arranged to effect the electrical contacting engagement and the disengagement therebetween, respectively, the arc blast disassociating the conductive material from at least one of the contacts.

4. In a switch device having a switch means accomodating chamber with a plurality of surfaces therein, terminal means disposed at least in part within the chamber, switch means movable in the chamber for circuit making engagement with the terminal means and disengagement therefrom wherein any arc blast created upon the disengagement of the switch means from the terminal means effects the depositing of minute conductive particles of conductive material from at least one of the terminal means and the switch means onto at least some of the surfaces of the plurality thereof; the improvement comprising means for preventing the establishment of a conductive path between the terminal means and the minute conductive particles deposited on at least one surface of the at least some surfaces, said preventing means including means integral with the at least one surface for positioning engagement with the terminal means, a free end on said positioning engagement means predeterminately spaced from the at least one surface and arranged so as to abut with the terminal means, wall means on said spacing engagement means integrally interconnected between the at least one surface and said free end portion and generally in circumscribing relation completely around said spacing engagement means, a marginal edge portion on said spacing engagement means generaly at the interconnection of said wall means with said free end portion, the terminal means including means extending predeterminately beyond said marginal edge portion and completely around it for shielding at least a band on said wall means extending generally in circumscribing relation completely thereabout from the depositing on said band of the minute conductive material particles created in response to the any arc blast between the terminal means and switch means upon the disengagement thereof so as to prevent the establishment of a conductive path of the deposited minute conductive material particles across said band between the at least one surface and the terminal means.

5. A method of making a switch device having a chamber with a plurality of surfaces therein, terminal means for disposition at least in part within the chamber, switch means for circuit making engagement with the terminal means and disengagement therefrom with any arc blast created upon the disengagement effecting the emanation from at least one of the switch means and terminal means of minute particles of conductive material and the depositing of the minute particles on at least one of the surfaces of the surface plurality, the method comprising the steps of:

(a) providing on the at least one surface an integral pedestal having a free end portion predeterminately spaced from the at least one surface and wall means interconnected between the free end portion and the at least one surface so as to extend completely around the pedestal in circumscribing relation therewith; and (b) mounting the terminal means with respect to the pedestal so that a peripheral portion of the terminal means extends at least a predetermined distance beyond the free end portion and shielding thereby at least a band extending completely about the wall means in the circumscribing relation therwith and disposed between the free end portion and the at least one surface from the depositing on the band of the minute particles of the conductive material so as to obviate the establishment of a conductive path of the minute particles of the conductive material on the band between the at least one surface and the terminal means.

6. The method as set forth in claim 5 wherein the mounting and shielding step comprises spacing the peripheral portion of the terminal means from the remaining surfaces of the surface plurality so as to also obviate the establishment of another conductive path between the terminal means peripheral portion and any conductive particles deposited on the remaining surfaces.

* * * * *